US005257247A

United States Patent [19]

Miche et al.

[11] Patent Number: 5,257,247

[45] Date of Patent: Oct. 26, 1993

[54] SAFETY VALVE FOR DIVER'S TIMEPIECE

[75] Inventors: Marc-André Miche; Gérard Palix, both of Bienne, Switzerland

[73] Assignee: SMH Management Services AG, Biel, Switzerland

[21] Appl. No.: 8,584

[22] Filed: Jan. 25, 1993

[30] Foreign Application Priority Data

Feb. 7, 1992 [CH] Switzerland ..... 356/92

[51] Int. Cl.[5] ..... G04B 29/00; G04B 37/00

[52] U.S. Cl. ..... 368/290; 368/319

[58] Field of Search ..... 368/287-291, 368/308, 319

[56] References Cited

U.S. PATENT DOCUMENTS

| | | | |
|---|---|---|---|
| 3,453,819 | 7/1969 | Simon | 368/290 |
| 3,994,125 | 11/1976 | Wenger | 368/290 |
| 4,292,682 | 9/1981 | Wenger | 368/289 |
| 4,689,158 | 5/1978 | Wenger | 368/289 |

FOREIGN PATENT DOCUMENTS

| | | |
|---|---|---|
| 204911 | 8/1937 | Switzerland . |
| 337467 | 3/1957 | Switzerland . |
| 492246 | 11/1967 | Switzerland . |

*Primary Examiner*—Vit W. Miska

*Attorney, Agent, or Firm*—Griffin, Butler, Whisenhunt & Kurtossy

[57] ABSTRACT

This valve (1) for a watch case comprises a head (3) and a tube (4) onto which the head can be screwed. A stem (8) fixed to a core (5) borne by the head is surrounded by a return spring (7) bearing, on the one hand, under the head and, on the other hand, onto a bottom (3) exhibited by the tube through a ring (14) and a first packing (6). A second packing (18) is mounted under the head in line with the tube. When the head is screwed down the second packing (18) is compressed and the valve is inoperative and at the same time totally sealed. When the head is unscrewed the first packing (6) is able to rise up against the return force of spring (7) if the fluid pressure prevailing within the case is higher than that on the exterior thereof. An excessive interior pressure which can damage the case is thus avoided.

4 Claims, 1 Drawing Sheet

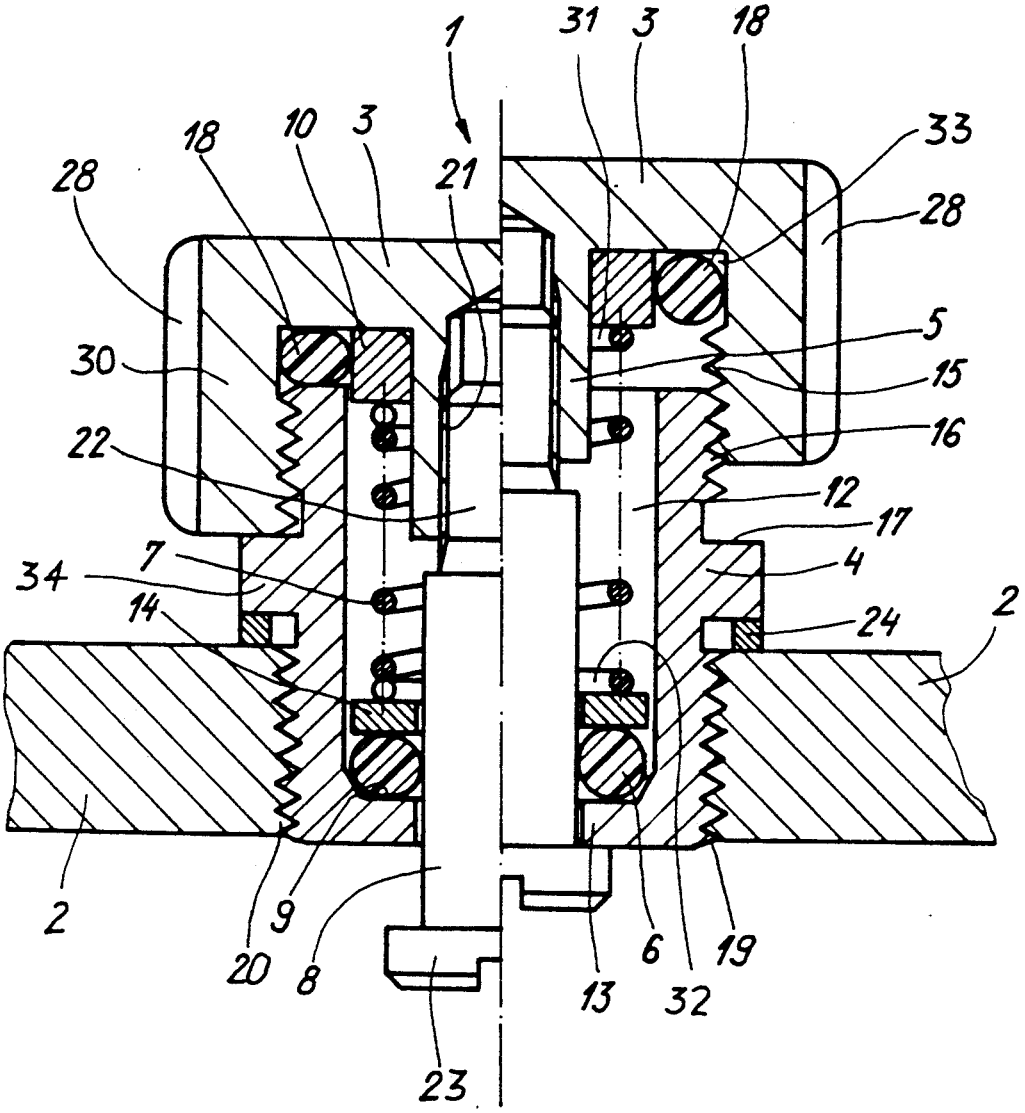
1
31
3
18
33
28
18
10
3
21
28
30
5
15
22
16
12
17
34
7
4
14
24
2
2
20
9
8
13
6
32
19
23

SAFETY VALVE FOR DIVER'S TIMEPIECE

The present invention relates to a safety valve comprising a hollowed-out head provided with a skirt and a central core extended by a stem, a tube onto which the head is mounted, such tube being intended to be secured to a case of a timepiece and including a bottom traversed by the stem and a helical return spring surrounding the core and the stem.

BACKGROUND OF THE INVENTION

It is known to provide a watchcase with a valve.

Nevertheless, in existing designs, the purpose of the valve is to enable one either to inject a gas into the case in order to obtain therein a pressure greater than the ambient pressure, thus preventing penetration of water, vapour or dust to the interior of the case or, to the contrary, establish a vacuum within the case in order to protect the movement from the effects of air contained in the case at the time of its closure, or with the purpose of improving the tightness of the case by the ambient pressure contributing to force the different constitutive elements thereof against one another.

Nevertheless, such designs have never been employed in order to eliminate effects on the watchcase of a long immobilization of the latter in a gaseous medium under heavy pressure.

Effectively, it has been determined that whatever be the sealing qualities of watchcases provided up to the present, when they are subjected during relatively long periods on the order of several hundreds of hours to relatively heavy pressure on the order of several tens of atmospheres and especially when the surrounding atmosphere is formed of a gas having small dimension molecules as is the case with helium for instance which is frequently employed in diving bells, the pressure within the watchcase ends up by increasing considerably.

Such conditions of use are not hypothetical but exist in reality, in particular when the watch is employed at great depths underseas in the course of work taking place under a bell. The dive is said to be "in saturation" (reference to the standards annex of ISO standard 6425 for diver's watches).

During return of the watch into an atmosphere at normal pressure, and this in spite of the decompression stages which are necessary for the occupant of the bell, there arises an interior overpressure in the watchcase, which may bring about bursting of the latter, that is to say, ejection of the crystal in particular.

To overcome this difficulty, patent document CH-A-492 246 proposes a valve arranged in a manner to open automatically when the ambient pressure is lower than that prevailing within the case and to close in the inverse case in order to prevent that there occur within the case an interior over pressure susceptible to bring about deterioration of the case during intermittent employment of the watch in an over-pressurized gaseous medium and during passage of the watch from the over-pressurized medium to the medium at ordinary pressure.

Given that precautions are taken in order to avoid bursting of the watch during a return from great depths, but in a gaseous medium, the wearer of the watch may wish to employ the same watch for great depths, but in a liquid medium on such latter occasion. Now the design recommended by the cited document shows that the valve suffers from shortcomings if the high pressure is applied to the exterior of the watch. The 0 ring employed may roll out of its housing if a high pressure is applied onto the head of the valve. Otherwise, from the fact that the course of the valve is limited in the return direction, it is necessary to arrange the housing of the seal with great precision in order to assure good application of the latter onto the watchcase. Simply stated, it is not easy to design a valve opening easily when the interior pressure is greater than the ambient pressure and hermetically closing when the pressure is directed in the other sense. It may also be mentioned that the use of the timepiece in a liquid medium is much more frequent than utilization under a bell with a helium atmosphere. It is thus necessary that the valve guarantee a perfect sealing during submarine dives while assuring its role as safety valve if the timepiece is occasionally employed under a bell.

SUMMARY OF THE INVENTION

In order to guarantee such double function without fail, the valve of the present invention is characterized in that means are employed in order to permit the head to occupy an "out" position or an "in" position, that the first end of the spring bears under the head and the second end onto a ring compressing in turn a first packing arranged on said bottom and that a second packing is arranged under the head in line with the tube in a manner such that when the head is in the "in" position said second packing is pressed against the tube, the valve being then inoperative and totally sealed and when the head is in the "out" position said first packing is able to rise up against the return force of the spring if the pressure of the fluid prevailing within the case is higher than that prevailing at the exterior in order to avoid excessive pressure capable of damaging the case.

The invention will now be understood upon reading the description which follows and with the help of the drawing which illustrates it by way of example.

BRIEF DESCRIPTION OF THE DRAWING

The single figure is a cross-section taken in the valve of the invention, the right hand part showing the head in the "out" position and the left hand part the head in the "in" position.

DESCRIPTION OF THE PREFERRED EMBODIMENT

As is apparent on the figure, the safety valve 1 comprises a hollowed-out head 3 provided with a skirt 30 and a central core 5 extended by a stem 8. The head is mounted on a tube 4 secured to a caseband 2 forming a part of the case of a timepiece. The figure shows this fastening takes place by screwing of the tube into the caseband, the tube bearing threads 19 and the caseband an internal threading 20. Tube 4 includes a bottom 13 traversed by stem 8. Core 5 and stem 8 are surrounded by a helical return spring 7.

The valve is noteworthy in that it employs means to enable the head to occupy an "out" position (right hand side of the figure) or an "in" position (left hand side of the figure). As is seen on the figure, such means consist in threads 16 formed on the exterior of tube 4, such threads cooperating with internal threading 15 provided on the interior of skirt 30. The head may thus assume a screwed-down "in" position and an unscrewed "out" position. The invention is however not limited to the means shown here, such means may be different as for example the use of a bayonet-type closing.

The figure further shows that spring 7 bears under head 3 through its first end 31. The second end 32 of spring 7 bears against a ring 14 which compresses in turn a first packing 6 arranged on the bottom 13 exhibited by tube 4. It is also seen on the figure that a second packing 18 is arranged under head 3 in line with tube 4.

Thus, when head 3 is in the "in" position, the second packing 18 is pressed against tube 4. It follows that the valve is then inoperative and completely sealed. When the timepiece is employed in a liquid medium and at great depths the diver will screw down the head of the valve which renders the valve absolutely tight, not only through the effect of crushing the second packing 18, but further through the effect of additional compression of the first packing 6, the spring 7 developing an additional force on such first packing when head 3 is screwed down.

Inversely, when head 3 is in the "out" position, the return spring 7 is relaxed and the second packing 18 is no longer active. Thus, the first packing 6 is capable of rising up against the return force of spring 7 when the fluid pressure prevailing within the case is higher than that prevailing at the exterior. This is the case of the stay in the diving bell suggested hereinabove. Thus, in such case, the diver will unscrew the head of the valve to avoid an excessive pressure risking damage to the case, for example through ejection of the crystal.

In the embodiment illustrated on the figure, end 31 of the return spring 7 does not bear directly under head 3, but is supported under such head through a ring 10 surrounding the central core 5. The figure shows that ring 10 forms, together with skirt 30 and the underside of head 3, a housing 33 in which is placed the second packing 18. The figure also shows that stem 8 includes threads 22 which are screwed into internal threading 21 formed in the central core 5. Stem 8 is terminated by a head 23 enabling screwing the stem onto the core.

It will also be noted that skirt 30 comprises longitudinal knurling 28 permitting good gripping. Finally, tube 4 bears a collar 34 which on the one hand serves to limit the travel of the head and on the other hand enables sealing the tube relative to the caseband 2 through a packing 24.

What we claim is:

1. A safety valve comprising a hollowed-out head provided with a skirt and a central core extended by a stem, a tube onto which the head is mounted, such tube being intended to be secured onto a timepiece case and including a bottom traversed by the stem and a helical return spring surrounding the core and the stem, means being operable to enable the head to occupy an "out" position or an "in" position, a first end of the spring bearing under the head and a second end onto a ring which in turn compresses a first packing arranged on said bottom, a second packing being arranged under the head in line with the tube in a manner such when the head is in the "in" position said second packing is pressed against the tube, the valve then being inoperative and totally sealed, and when the head is in the "out" position said first packing is able to rise up against the return force of the spring if the fluid pressure prevailing within the case is higher than that prevailing on the exterior so as to avoid excessive pressure capable of damaging the case.

2. A valve as set forth in claim 1 wherein said means consist of threads formed on the outside of the tube, said threads cooperating with internal threading formed on the interior of the skirt in order to permit the head to take up an unscrewed "out" position or a screwed-down "in" position.

3. A valve as set forth in claim 1 wherein the first end of the spring bears on a ring surrounding the central core and resting under the head, such ring forming, together with the skirt and the underside of the head, a housing for the second packing.

4. A valve as set forth in claim 1 wherein the stem includes threads screwed into internal threading formed in the central core.

* * * * *